US011944915B2

(12) United States Patent
Hsu

(10) Patent No.: US 11,944,915 B2
(45) Date of Patent: Apr. 2, 2024

(54) PLUSH TOY WITH INTERNAL SKELETON AND ROTATABLE HEAD

(71) Applicant: Great Eastern Entertainment Co., Compton, CA (US)

(72) Inventor: Kent Hsu, Torrance, CA (US)

( * ) Notice: Subject to any disclaimer, the term of this patent is extended or adjusted under 35 U.S.C. 154(b) by 204 days.

(21) Appl. No.: 17/832,504

(22) Filed: Jun. 3, 2022

(65) Prior Publication Data

US 2023/0390658 A1 Dec. 7, 2023

(51) Int. Cl.

| | |
|---|---|
| ***A63H 3/02*** | (2006.01) |
| ***A63H 3/04*** | (2006.01) |
| ***A63H 3/16*** | (2006.01) |

(52) U.S. Cl.

CPC ..... *A63H 3/16* (2013.01); *A63H 3/02* (2013.01); *A63H 3/04* (2013.01)

(58) Field of Classification Search

CPC ..... A63H 3/02; A63H 3/04

See application file for complete search history.

(56) References Cited

U.S. PATENT DOCUMENTS

| | | | | |
|---|---|---|---|---|
| 1,359,030 | A | 11/1920 | Cabana | |
| 1,374,343 | A | 4/1921 | Wiener | |
| 1,509,604 | A | 9/1924 | Myers | |
| 2,663,971 | A | 12/1953 | Ippolito | |
| 3,678,626 | A | 7/1972 | Goldfarb et al. | |
| 3,982,353 | A | 9/1976 | Christiansen | |
| 4,268,991 | A | 5/1981 | Cotey et al. | |
| 4,571,209 | A | 2/1986 | Manning et al. | |
| 5,630,745 | A * | 5/1997 | Yeh | A63H 3/04 446/385 |
| 5,713,779 | A | 2/1998 | Chen | |
| 5,762,531 | A * | 6/1998 | Witkin | A63H 3/04 446/374 |
| 6,010,388 | A | 1/2000 | Pillai et al. | |
| 6,033,284 | A | 3/2000 | Rodriguez Ferre | |
| 6,074,270 | A | 6/2000 | Wilcox et al. | |
| 6,086,447 | A | 7/2000 | Tucker | |
| 6,110,002 | A * | 8/2000 | Langton | A63H 3/04 446/373 |
| 6,170,721 | B1 * | 1/2001 | Chen | A63H 3/003 223/94 |
| 6,220,922 | B1 | 4/2001 | Lee et al. | |
| 6,422,916 | B1 | 7/2002 | Enku | |
| 6,537,130 | B1 | 3/2003 | Lee et al. | |
| 6,932,669 | B2 | 8/2005 | Lee et al. | |
| 7,479,054 | B2 * | 1/2009 | Wittenberg | A63H 9/00 446/376 |

(Continued)

FOREIGN PATENT DOCUMENTS

| | | |
|---|---|---|
| EP | 1428563 B1 | 6/2004 |

*Primary Examiner* — John A Ricci

(74) *Attorney, Agent, or Firm* — McConnell Law Firm, P.C.; Robert McConnell

(57) ABSTRACT

A plush toy with an internal skeleton and a PVC head attached with a variety of coupling mechanisms. The plush toy includes a movable and poseable internal skeleton that attaches to a neck connector allowing the use of a PVC head with the plush body. Further, the present invention includes a unique shoulder design that assists in retention of plush material in the plush toy body. Additionally, four unique head coupling configurations are disclosed that enable connection of a PVC toy head to a plush body.

8 Claims, 12 Drawing Sheets

(56) References Cited

U.S. PATENT DOCUMENTS

| | | | | |
|---|---|---|---|---|
| 2002/0002022 | A1 | 1/2002 | Wilcox et al. | |
| 2002/0055322 | A1 | 2/2002 | Lee et al. | |
| 2003/0036334 | A1 | 2/2003 | Shamitoff | |
| 2004/0092203 | A1 | 5/2004 | Lee et al. | |
| 2010/0035510 | A1* | 2/2010 | Joubert Nogueroles | A63H 3/04 446/374 |
| 2014/0199912 | A1* | 7/2014 | Fish | A63H 3/04 446/383 |
| 2015/0133022 | A1 | 5/2015 | Ushiba et al. | |
| 2015/0375127 | A1* | 12/2015 | Fukuchi | A63H 3/36 446/321 |

* cited by examiner

PLUSH TOY WITH INTERNAL SKELETON AND ROTATABLE HEAD

BACKGROUND OF THE INVENTION

Field of the Invention

The present invention relates to plush toys, specifically toys consisting of a soft exterior material covering either a soft or firm stuffing material. Plush toys are made of various exterior materials such as soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. These exterior materials are formed of synthetic materials such as polyester, nylon, plastics and/or natural materials such as cotton, wool or real fur. Common stuffing materials may include polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

Plush toys are enjoyed by children and adults alike. Children or adults may use them solely for the enjoyment of play but many adults may collect them for enjoyment or financial gain. Plush toys are often based on characters ranging from zoo/farm animals to characters invented by their manufacturers to famous licensed characters such as super heroes or cartoon characters. Plush toys are a significant market enjoyed by those of all ages and all walks of life.

Plush toys well known in the art often have a body and head formed of the same plush material. However, in some circumstances, it is desirable to combine a plush body with a PVC or plastic head for the toy. In the past, this combination has been challenging due to the methods of attaching the plush head versus a PVC head. The present invention addresses these challenges to provide a toy with a plush body and a PVC head.

SUMMARY OF THE INVENTION

The present invention is a novel plush toy with an internal skeleton and a PVC head attached with a variety of coupling mechanisms. The novel plush toy includes a movable and poseable internal skeleton that attaches to a neck connector allowing the use of a PVC head with the plush body. Further, the present invention includes a unique shoulder design that assists in retention of plush material in the plush toy body.

Additionally, four unique head coupling configurations are disclosed that enable connection of a PVC toy head to a plush body. Each of these coupling configurations allow movement of the PVC head as well as removal and reattachment of the head. These coupling configurations include a tabbed prong connector, ball and socket connector, a slotted connector and a threaded connector. These novel additions enable a unique plush toy with PVC head.

DESCRIPTION OF THE PREFERRED EMBODIMENT

The following detailed description refers to the preferred embodiment of the disclosed invention as shown in the attached figures and in the below description. This detailed description is not meant to limit the scope of the invention in any way but is intended to disclose the preferred embodiment/best mode of the invention at the time of filing this application.

Figure 1:
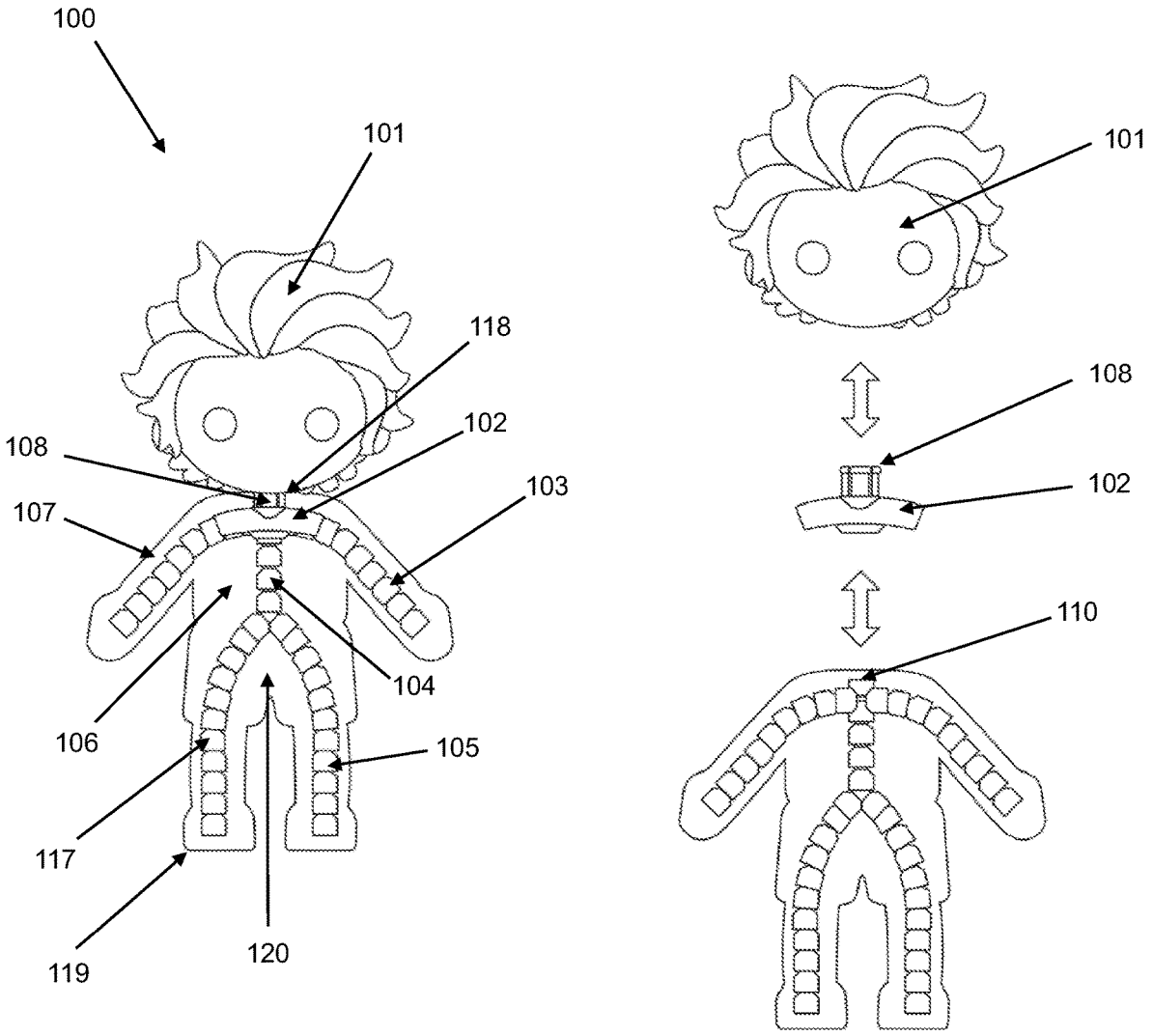
FIG. 1 is a view of the first embodiment of the plush toy with internal skeleton and PVC head.

FIG. 1 is a view of the first embodiment of the present plush toy with internal skeleton and rotatable head 100. Head 101 is the head of the plush toy and in the preferred embodiment is made of PVC (polyvinyl chloride), which is a type of plastic used for dolls. Typically, plush toys are manufactured with heads also made of plush materials, but in this case, PVC is utilized. The use of a PVC head for a plush toy is an improvement that is made possible by the novel head connection apparatuses disclosed herein. This improvement allows the use of molded heads allows the creation of a head model with significantly more detail than a plush head but connected to the soft and enjoyable plush body. While PVC is used in the preferred embodiment, the invention is not so limited and any suitable material could be used such as plastic, rubber, wood, plush or any other material well known in the art for use in the manufacture of dolls.

Plush material retaining shoulder 102 is located at the spot where neck connector 108 of the toy meets the skeleton 107 of the toy. Plush material retaining shoulder 102 is design to assist in retaining the plush material in the body 106 of plush toy 100. Skeleton 107 is comprised of legs 105, arms 103, and spine 104. Each part of skeleton 107 is made up of skeleton pieces 117 that, in the preferred embodiment, are made of plastic with both female and male coupling ends. The male coupling end fits into the female coupling end of another skeleton piece 117 such that they become attached but can also move rotationally within the coupling end. This movement allows skeleton 107 to be moveable and poseable for the enjoyment of the user. The arms, legs and body can be moved into various positions and held there by skeleton 107.

Body 106 is comprised of skeleton 107, stuffing 120 and plush cover 119. Stuffing 120 fits over and around skeleton 107 and provides the soft feeling desired in plush toys. Stuffing 120 is polyester fiber in the preferred embodiment but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 119 forms the exterior of the plush toy and includes the preferred exterior design of the toy. Plush cover 119 can be manufactured using any of many methods well known in the art, but in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 119 also includes neck hole 118 where the neck connector 108 fits through plush cover 119.

In the preferred embodiment, neck connector 108 is formed as part of plush material retaining shoulder 102. Plush material retaining shoulder 102 connects to skeleton 107 by skeleton connector 110. Plush material retaining shoulder 102 is also shaped to prevent stuffing 120 from exiting through neck hole 118. It achieves this by the shoulder portion of the plush material retaining shoulder 102 pushing stuffing 120 into the plush body and forming a barrier that prevents stuffing 120 from coming out of neck hole 118. Neck connector 108 and plush material retaining shoulder 102 are formed of plastic in the preferred embodiment, but any suitable material known in the art could be utilized.

Neck connector 108 is designed to couple to head 101 through a variety of coupling types shown in this disclosure. These unique coupling types enable the improvement of attaching a PVC head to a plush body in a plush toy. In this embodiment, neck connector 108 is a tabbed connector that couples with a similarly shaped receptacle connector installed within the base of head 101. In this embodiment, the head 101 snaps onto neck connector 108 (the connection is shown in more detail in a later figure). When snapped onto the neck connector 108, the head 101 is able to rotate in a circular motion around its vertical axis. Further, the head is easily removed and replaced with another head for the enjoyment of its user. With plush material retaining shoulder 102 attached to skeleton connector 110, the body 106 may be filled with stuffing 120 that is retained by plush cover 119. Further, plush material retaining shoulder 102 prevents stuffing 120 from exiting through neck hole 118 in plush cover 119. The easy connection of head 101 to neck connector 108 allows the use of unique and different materials for head 101 including PVC and other plastics. When head 101 is snapped onto neck connector 108 the complete toy is formed, including the plush body 106 and PVC head 101. The head 101 is rotatable around its vertical axis and removable. The body is posable but also retains the desired characteristics of a plush body. The characteristics of this plush toy with PVC head are unique and provide playing enjoyment for the user.

Figure 2:
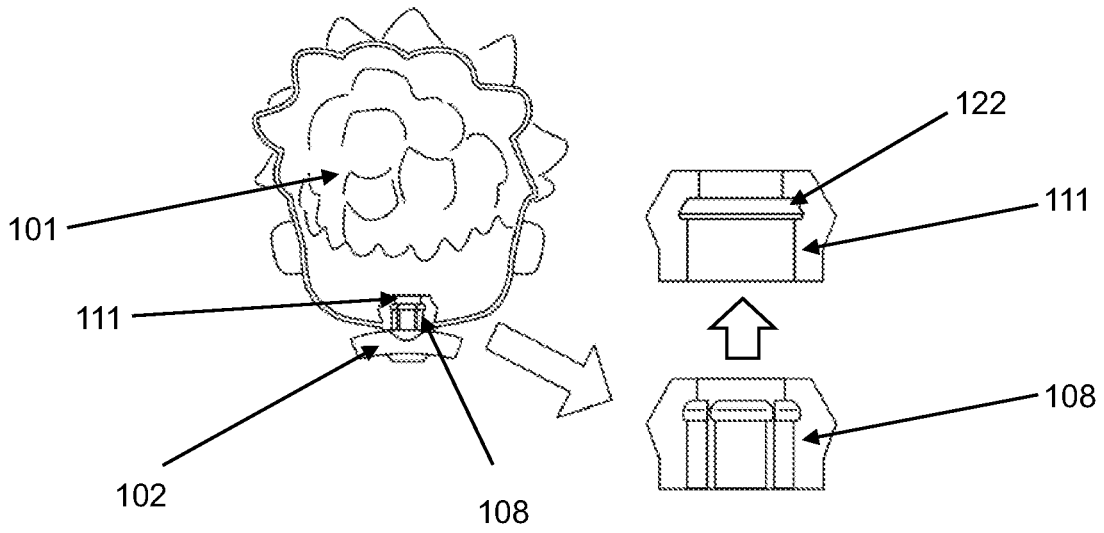
FIG. 2 is a view of the neck connector of the first embodiment of the plush toy with internal skeleton and PVC head.

FIG. 2 shows a view of head 101 with neck connector 108 coupled with neck receptacle 111. In this view, plush material retaining shoulder 102 is also shown connected to neck connector 108. Neck connector 108 is a male connector with four individual tabbed prongs in this embodiment. This neck connector 108 has a base where it is attached to plush material retaining shoulder 102. The tabbed prongs of this connector start at the base and are arranged in substantially circular fashion. Each prong is separated by a small void that allows the prongs to be squeezed apart such that the circumference of the circle formed by the prongs may be increased and the prongs can be pushed over the lip of the neck receptacle. Each prong as a tab at the opposite end from the base.

Neck receptacle 111 is a substantially circular post type connector with lip 121 at one end, designed to couple with neck connector 108. When the prongs of neck connector 108 are expanded, they fit over neck receptacle 111. When pushed along the length of neck receptacle 111, the tab of each prong is pushed over lip 121 of neck receptacle. Once pushed over lip 121, the tabs of the prongs align with lip 121 of neck receptacle 111 to provide a secure fit such that neck connector 108 and neck receptacle 111 are firmly coupled and attached to each other. In this way, head 101 can be attached to plush body 106. While the attachment is secure, the neck connector 108 may still be removed from neck receptacle 111. Also, due to the circular nature of both the connector and receptacle, head 101 may rotate around its vertical axis.

Figure 3:
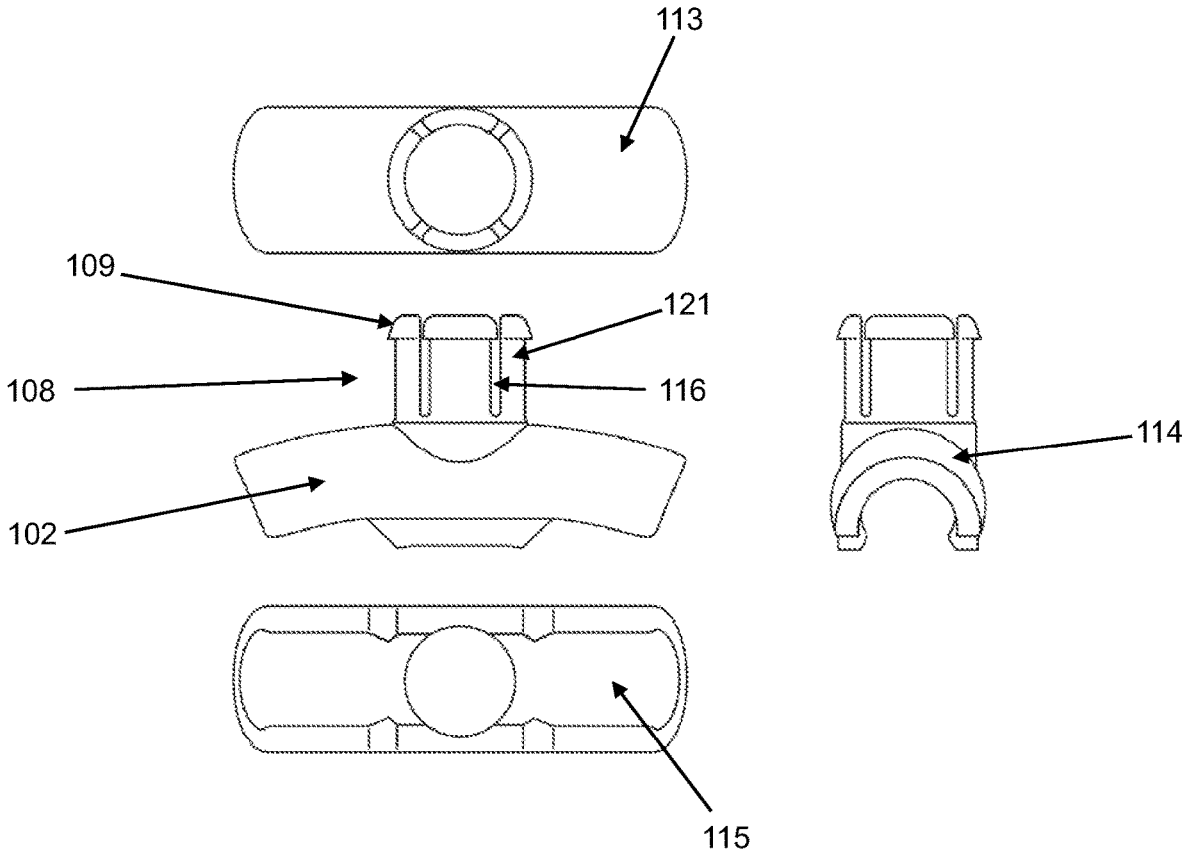
FIG. 3 is a view of the plush material retaining shoulder with first embodiment neck connector of the plush toy with internal skeleton and PVC head.

FIG. 3 shows a detailed view of plush material retaining shoulder 102 and neck connector 108. In this view, prong 121, void 116 and tab 109 of neck connector 108 are clearly visible. Prong 121 is the prong discussed above in relation to FIG. 2 and neck connector 108, as are tab 109 and void 116 related to the discussion above. In this view, shoulder top 113 shows the top portion of plush material retaining shoulder 102. Side shoulder 114 is the side view of plush material retaining shoulder 102. Lastly, bottom shoulder 115 is a bottom view of plush material retaining shoulder 102. In the preferred embodiment, neck connector 108 and plush material retaining shoulder 102 are made of molded plastic, but could be made of any other suitable material well known in the art.

Figure 4:
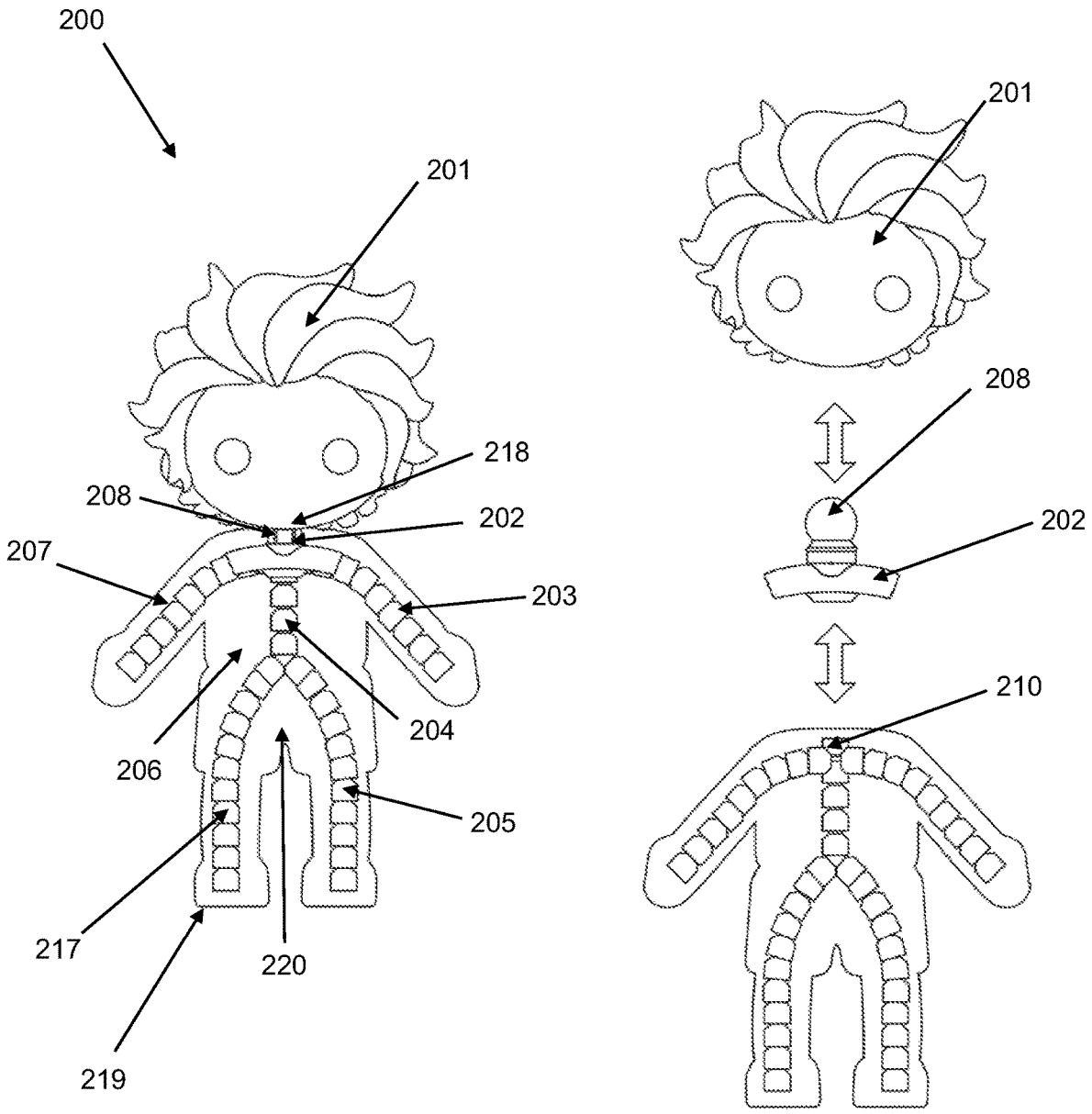
FIG. 4 is a view of the second embodiment of the plush toy with internal skeleton and PVC head.

FIG. 4 displays an alternate embodiment of plush toy with internal skeleton and rotatable head 200 with a ball and socket neck connector 208 for head 201. Head 201 is the head of the plush toy and in this embodiment is made of PVC (polyvinyl chloride), which is a type of plastic used for dolls. Typically, plush toys are manufactured with heads also made of plush materials, but in this case, PVC is utilized. While PVC is used in the preferred embodiment, the invention is not so limited and any suitable material could be used such as plastic, rubber, wood, plush or any other material well known in the art for use in the manufacture of dolls. Plush material retaining shoulder 202 is located at the spot where neck connector 208 of the toy meets the skeleton 207 of the toy. Plush material retaining shoulder 202 is design to assist in retaining the plush material in the body 206 of plush toy 200. Skeleton 207 is comprised of legs 205, arms 203, and spine 204. Each part of skeleton 207 is made up of skeleton pieces 217 that, in the preferred embodiment, are made of plastic with both female and male coupling ends. The male coupling end fits into the female coupling end of another skeleton piece 217 such that they become attached but can also move rotationally within the coupling end. This movement allows skeleton 207 to be moveable and poseable for the enjoyment of the user. The arms, legs and body can be moved into various positions and held there by skeleton 207.

Body 206 is comprised of skeleton 207, stuffing 220 and plush cover 219. Stuffing 220 fits over and around skeleton 207 and provides the soft feeling desired in plush toys. As in the preferred embodiment, stuffing 220 is polyester fiber in this embodiment but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 219 forms the exterior of the plush toy and includes the preferred exterior design of the toy. Plush cover 219 can be manufactured using any of many methods well known in the art, but this embodiment as in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 219 also includes neck hole 218 where the neck connector 208 fits through plush cover 219.

In this embodiment, neck connector 208 is formed as part of plush material retaining shoulder 202. Plush material retaining shoulder 202 connects to skeleton 207 by skeleton connector 210. Plush material retaining shoulder 202 is also shaped to prevent stuffing 220 from exiting through neck hole 218. It achieves this by the shoulder portion of the plush material retaining shoulder 202 pushing stuffing 220 into the plush body and forming a barrier that prevents stuffing 220 from coming out of neck hole 218. Neck connector 208 and plush material retaining shoulder 202 are formed of plastic in this embodiment, but any suitable material known in the art could be utilized.

Neck connector 208 is designed to couple to head 201 through a variety of coupling types shown in this disclosure. In this embodiment, neck connector 208 is a ball connector that couples with a similarly shaped socket connector installed within the base of head 201. In this embodiment, the head 201 snaps onto neck connector 208 (the connection is shown in more detail in a later figure). When snapped onto the neck connector 208, the head 201 is able to rotate in a circular motion around its vertical axis. Further, the head is easily removed and replaced with another head for the enjoyment of its user. With plush material retaining shoulder 202 attached to skeleton connector 210, the body 206 may be filled with stuffing 220 that is retained by plush cover 219. Further, plush material retaining shoulder 202 prevents stuffing 220 from exiting through neck hole 218 in plush cover 219. The easy connection of head 201 to neck connector 208 allows the use of unique and different materials for head 201 including PVC and other plastics. When head 201 is snapped onto neck connector 208 the complete toy is formed, including the plush body 206 and PVC head 201. The head 201 is rotatable around its vertical axis and removable. The body is posable but also retains the desired characteristics of a plush body. The characteristics of this plush toy with PVC head are unique and provide playing enjoyment for the user.

Figure 5:
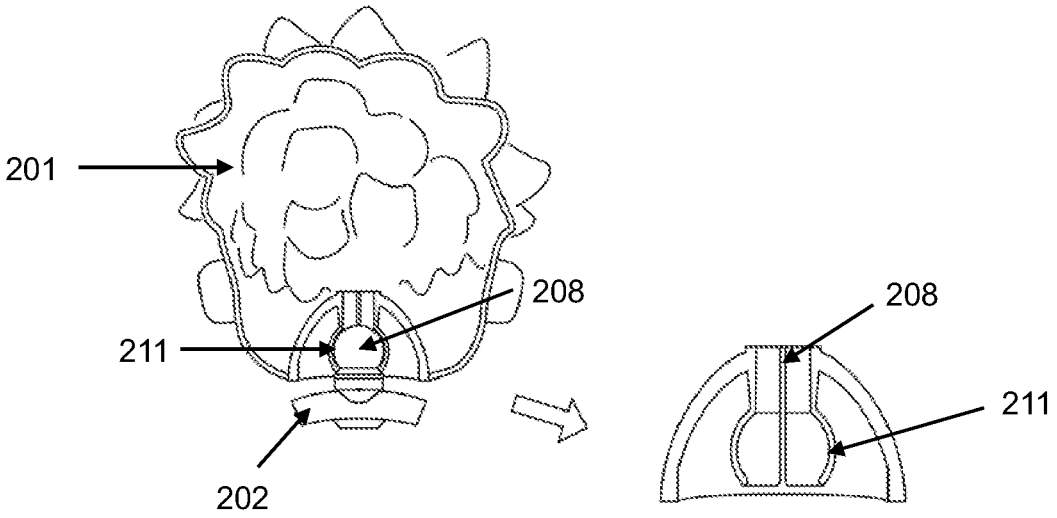
FIG. 5 is a view of the neck connector of the second embodiment of the plush toy with internal skeleton and PVC head.

FIG. 5 shows a view of head 201 with neck connector 208 inserted in neck receptacle 211. In this view, plush material retaining shoulder 202 is also shown connected to neck connector 208. Neck connector 208 is a ball shaped connector in this embodiment. This neck connector 208 has a base where it is attached to plush material retaining shoulder 202. The ball connector of connector 208 is substantially shaped as a ball and is designed to couple with neck receptacle 111 that has an interior shape that is a mirror image of neck connector 208.

The interior of neck receptacle 211 is the mirror image of substantially ball shaped neck connector 208 and is designed to couple with neck connector 208. Neck receptacle 211 is formed of flexible plastic, has an interior that is the inverse of a ball shape with an opening at the lower end of the receptacle. The interior is shaped to couple with the ball of neck connector 208. The receptacle can be expanded to fit the ball of neck connector 208 through the opening of the receptacle. Once pushed through the opening, neck receptacle 211 forms a strong coupling with neck connector 208 that retains the head 201 to the body. This strong coupling, due to the ball shape of neck connector 208 and neck receptacle 211 move freely around its x and y axes.

Figure 6:
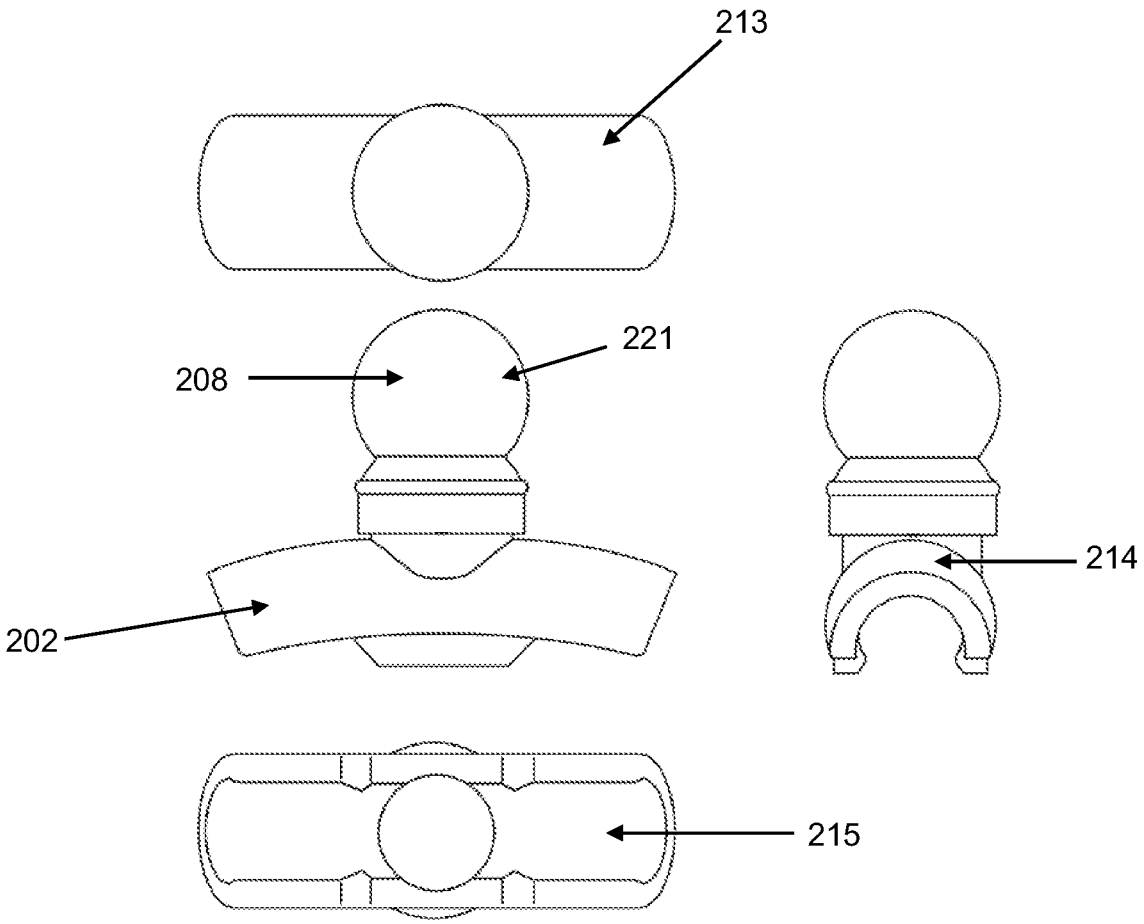
FIG. 6 is a view of the plush material retaining shoulder of the second embodiment of the plush toy with internal skeleton and PVC head.

FIG. 6 shows a detailed view of plush material retaining shoulder 202 and neck connector 208. In this view, ball 221 of neck connector 208 is clearly visible. Ball 221 is discussed in detail in relation to FIG. 5 above. Also in this view, shoulder top 213 shows the top portion of plush material retaining shoulder 202. Side shoulder 214 is the side view of plush material retaining shoulder 202. Lastly, bottom shoulder 215 is a bottom view of plush material retaining shoulder 202. In the preferred embodiment, neck connector 208 and plush material retaining shoulder 202 are made of molded plastic, but could be made of any other suitable material well known in the art.

Figure 7:
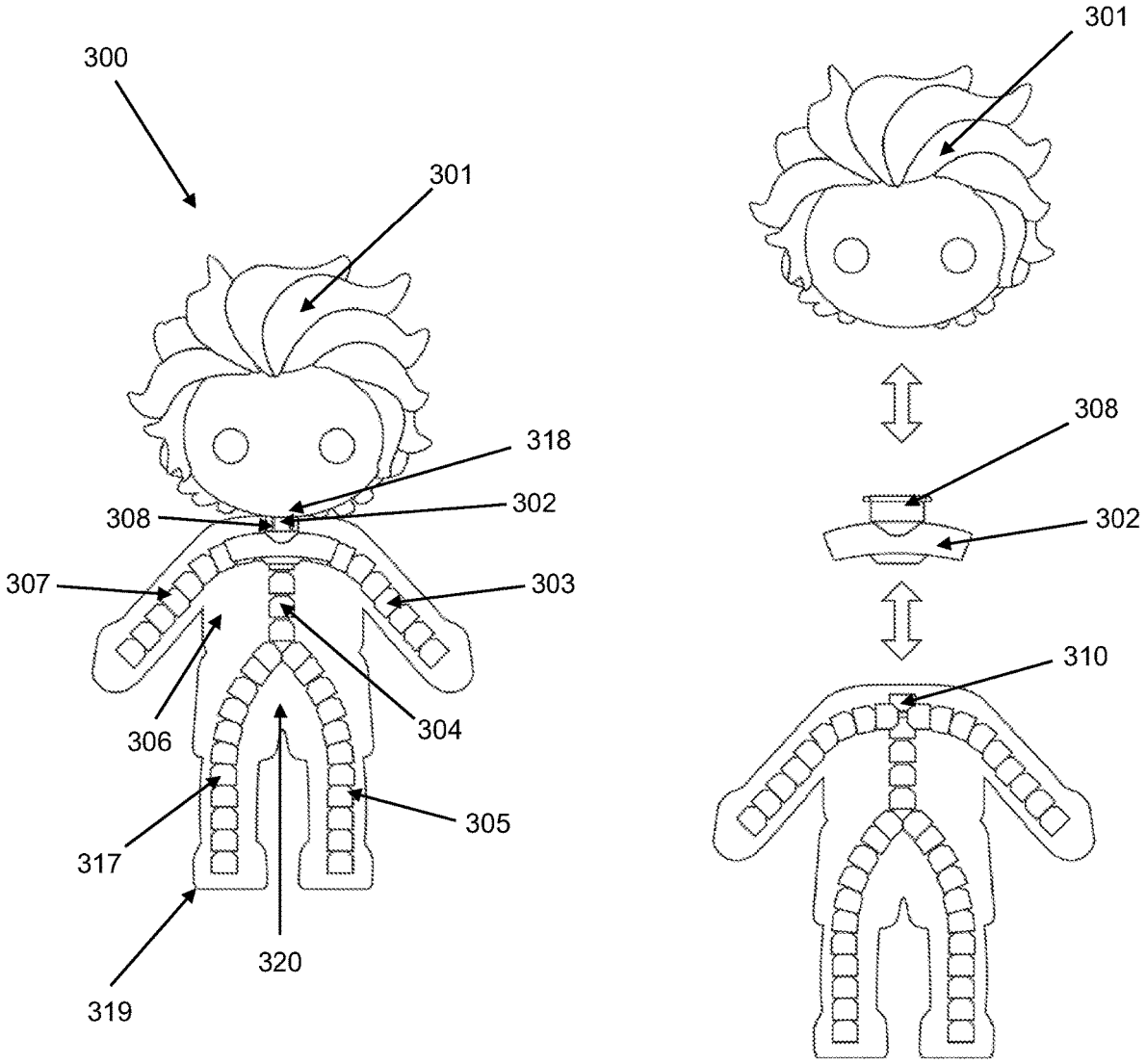
FIG. 7 is a view of the third embodiment of the plush toy with internal skeleton and PVC head.

FIG. 7 displays an alternate embodiment of plush toy with internal skeleton and rotatable head 300 with a slotted neck connector 308 for head 301. Head 301 is the head of the plush toy and in this embodiment, as in the other embodiments described herein, is made of PVC (polyvinyl chloride). Plush material retaining shoulder 302 is located at the spot where neck connector 308 of the toy meets the skeleton 307 of the toy. Plush material retaining shoulder 302 is design to assist in retaining the plush material in the body 306 of plush toy 300. Skeleton 307 is comprised of legs 305, arms 303, and spine 304. Each part of skeleton 307 is made up of skeleton pieces 317 that, in this embodiment, are made of plastic with both female and male coupling ends. The male coupling end fits into the female coupling end of another skeleton piece 317 such that they become attached but can also move rotationally within the coupling end. This movement allows skeleton 307 to be moveable and poseable for the enjoyment of the user. The arms, legs and body can be moved into various positions and held in position by skeleton 307.

Body 306 is comprised of skeleton 307, stuffing 320 and plush cover 319. Stuffing 320 fits over and around skeleton 307 and provides the soft feeling desired in plush toys. As in the preferred embodiment, stuffing 320 is polyester fiber but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 319 forms the exterior of the plush toy and includes the preferred exterior design of the toy. Plush cover 319 can be manufactured using any of many methods well known in the art, but this embodiment as in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 319 also includes neck hole 318 where the neck connector 308 fits through plush cover 319.

In this embodiment, neck connector 308 is formed as part of plush material retaining shoulder 302. Plush material retaining shoulder 302 connects to skeleton 307 by skeleton connector 310. Plush material retaining shoulder 302 is also shaped to prevent stuffing 320 from exiting through neck hole 318. It achieves this by the shoulder portion of the plush material retaining shoulder 302 pushing stuffing 320 into the plush body and forming a barrier that prevents stuffing 320 from coming out of neck hole 318. Neck connector 308 and plush material retaining shoulder 302 are formed of plastic in this embodiment, but any suitable material known in the art could be utilized.

Neck connector 308 is designed to couple to head 301 through a variety of coupling types shown in this disclosure. In this embodiment, neck connector 308 is a round connector with two rectangularly shaped tabs that extend outwardly from the round connector. Round neck connector with tabs couples with a round slotted connector that is sized to fit over neck connector 308. In this embodiment, the head 301 slides onto neck connector 308 when the tabs on neck connector 308 line up with the slots on the round socket located in head 301 (the connection is shown in more detail in a later figure). When the tabs of neck connector 308 are aligned with the slots in the socket, head 301 slides on to neck connector 308 and is attached to body 306. In this configuration, the head 301 is able to rotate in a circular motion around its vertical axis. Further, the head is easily removed and replaced with another head for the enjoyment of its user. With plush material retaining shoulder 302 attached to skeleton connector 310, the body 306 may be filled with stuffing 320 that is retained by plush cover 319. Further, plush material retaining shoulder 302 prevents stuffing 320 from exiting through neck hole 318 in plush cover 319. The easy connection of head 301 to neck connector 308 allows the use of unique and different materials for head 301 including PVC and other plastics. When head 301 is fitted onto neck connector 308 the complete toy is formed, including the plush body 306 and PVC head 301. The head 301 is rotatable around its vertical axis and removable. The body is posable but also retains the desired characteristics of a plush body. The characteristics of this plush toy with PVC head are unique and provide playing enjoyment for the user.

Figure 8:
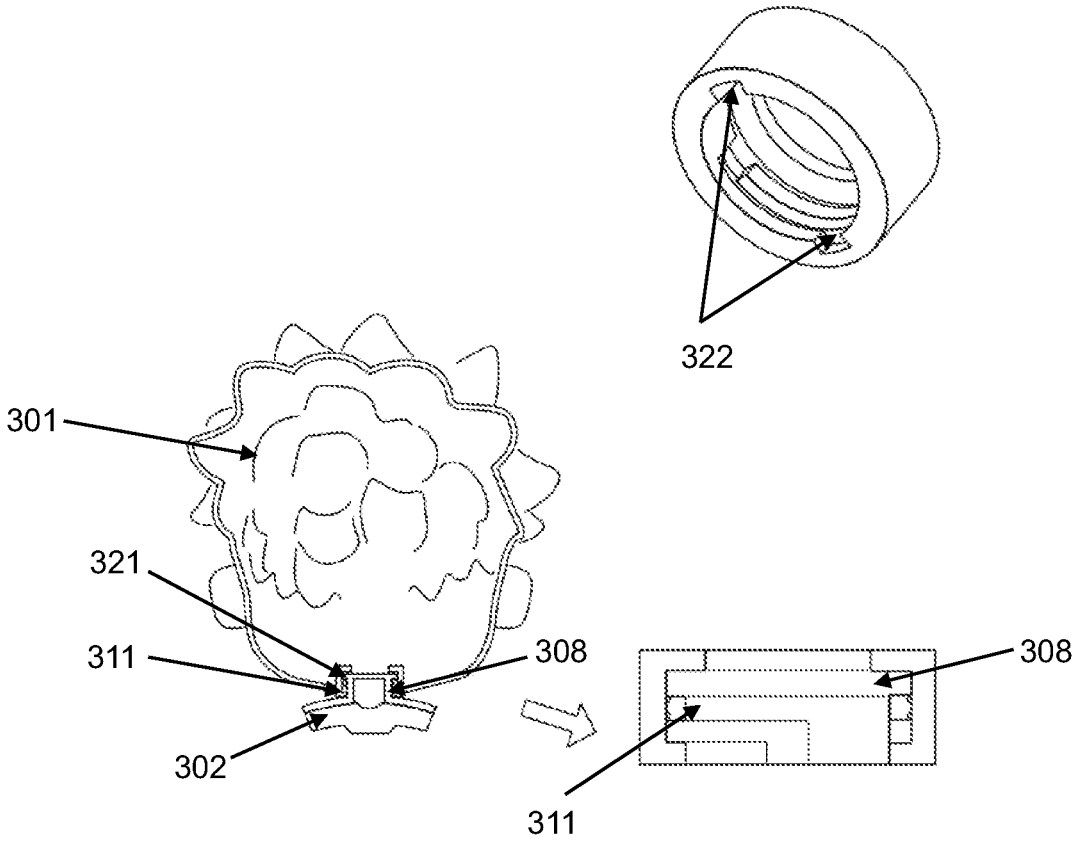
FIG. 8 is a view of the neck connector of the third embodiment of the plush toy with internal skeleton and PVC head.

FIG. 8 shows a view of head 301 with neck connector 308 inserted in neck receptacle 311. In this view, plush material retaining shoulder 302 is also shown connected to neck connector 308. In this embodiment, neck connector 308 has a generally round post shape with two rectangular tabs 321 located at the top of the post. Neck connector 308 has a base where it is attached to plush material retaining shoulder 302. The post of neck connector 308 is generally cylindrical in shape and is designed to couple with neck receptacle 311 that has an interior shape that also generally cylindrical and designed to fit over neck connector 308. Neck receptacle 311 fits in the base of head 301 and is the means to attach head 301 to body 306.

The interior of neck receptacle 311 is generally shaped as a cylindrical socket, with a size that is slightly greater than that of neck receptacle 311. Further, neck receptacle 311 includes two slots 322 formed from the base of the neck receptacle to channels in the neck receptacle 311. The slots 322 are shaped to couple with the tabs 321 of neck connector 308, and when the tabs 321 of neck connector 308 are aligned with the slots 322 of neck receptacle 311, neck connector 308 slides into neck receptacle 311. Once neck connector 308 is fully inserted in neck receptacle 311, the tabs 321 of neck connector 308 align with the channel at the top of neck receptacle 311. The tabs 321 are able to move in a circular motion around the x axis of the neck receptacle 311. The neck connector 308 and neck receptacle 311 are locked together except when the tabs 321 of neck connector 308 are aligned with the slots of neck connector 311. When the tabs 321 of neck connector 308 are aligned with the slots of neck connector 311, head 301 may be removed from body 306.

Figure 9:
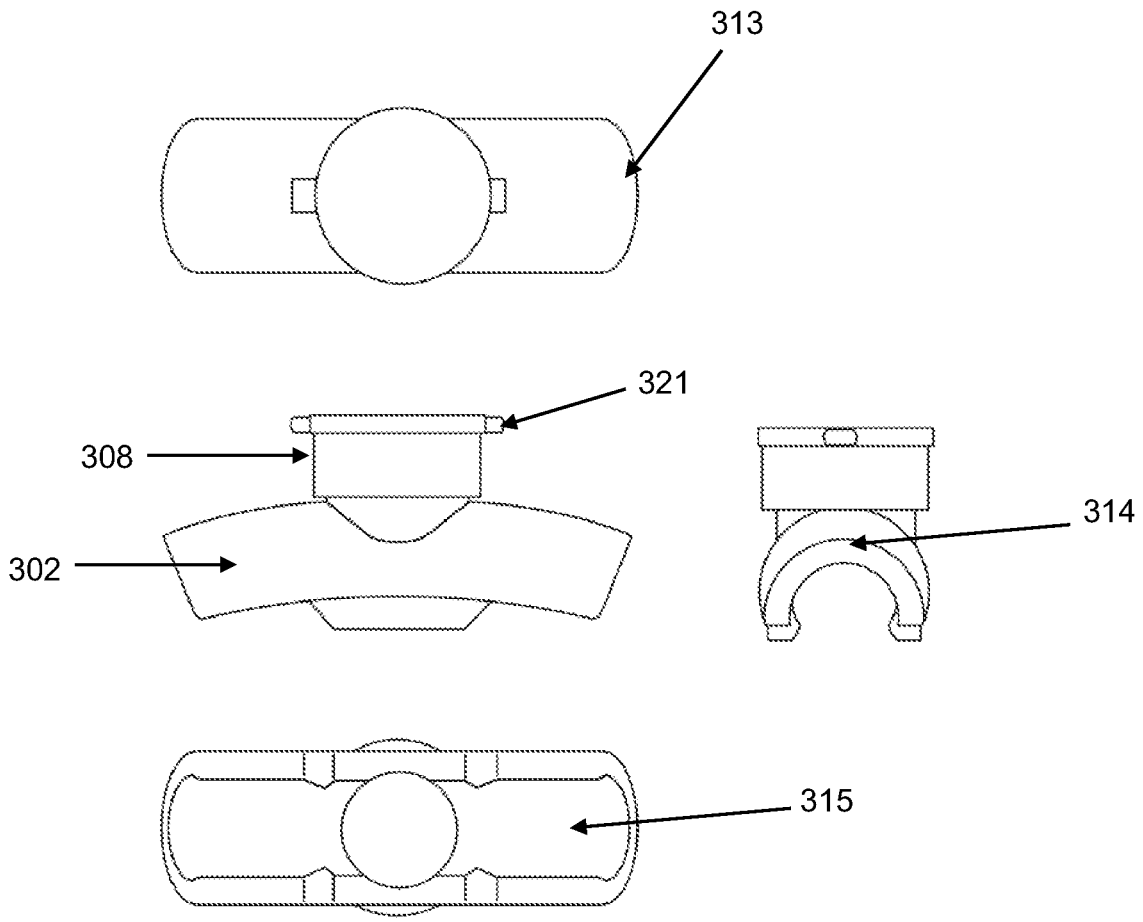
FIG. 9 is a view of the plush material retaining shoulder of the third embodiment of the plush toy with internal skeleton and PVC head.

FIG. 9 shows a detailed view of plush material retaining shoulder 302 and neck connector 308. In this view, tabs 321 of neck connector 308 is clearly visible. Tabs 321 are discussed in detail in relation to FIG. 8 above. Also in this view, shoulder top 313 shows the top portion of plush material retaining shoulder 302. Side shoulder 314 is the side view of plush material retaining shoulder 302. Lastly, bottom shoulder 315 is a bottom view of plush material retaining shoulder 302. In the preferred embodiment, neck connector 308 and plush material retaining shoulder 302 are made of molded plastic, but could be made of any other suitable material well known in the art.

Figure 10:
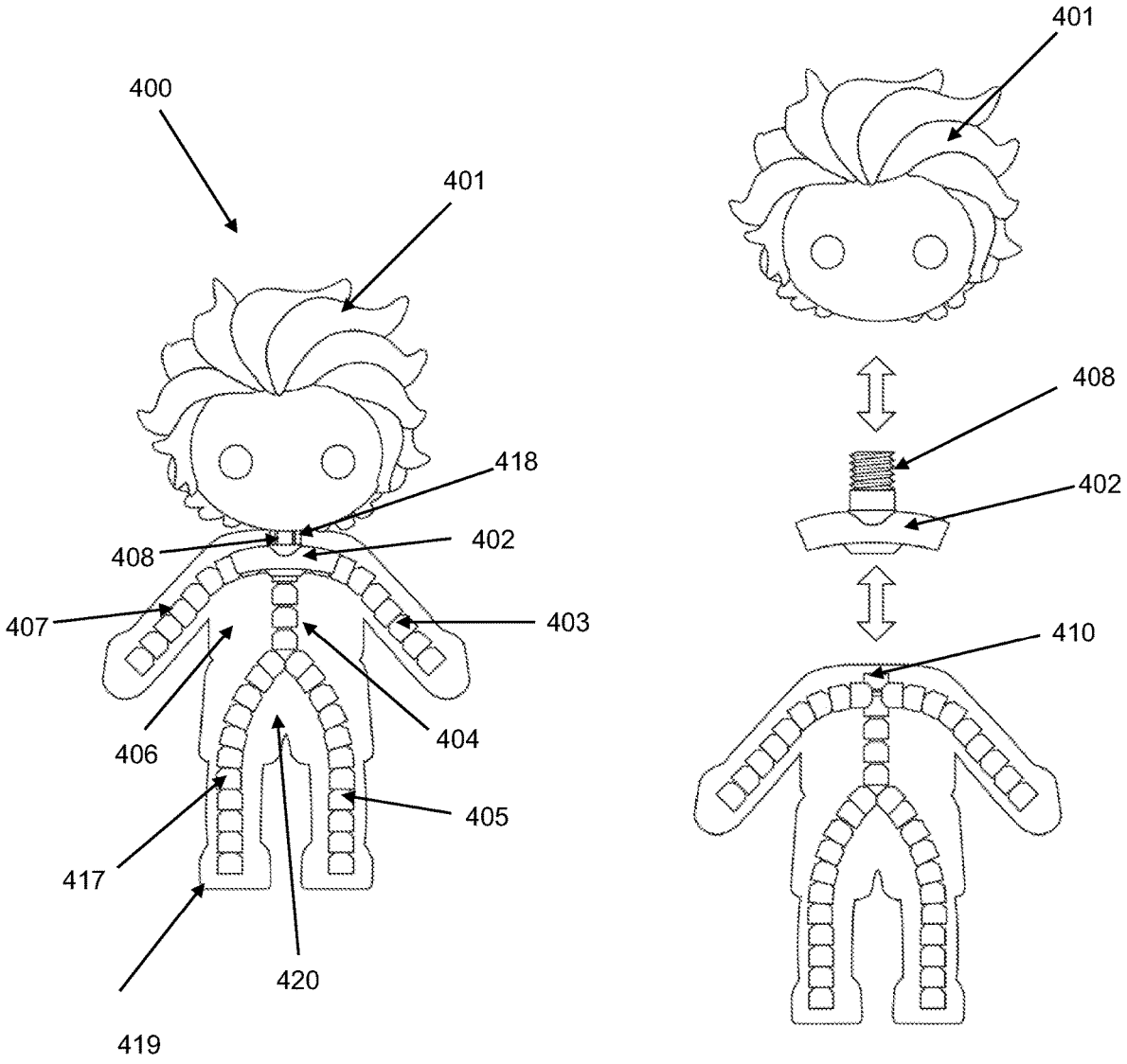
FIG. 10 is a view of the fourth embodiment of the plush toy with internal skeleton and PVC head.

FIG. 10 displays an alternate embodiment of plush toy with internal skeleton and rotatable head 400 with a threaded/screw type neck connector 408 for head 401. Head 401 is the head of the plush toy and in this embodiment, as in the other embodiments described herein, is made of PVC (polyvinyl chloride). Plush material retaining shoulder 402 is located at the spot where neck connector 408 of the toy meets the skeleton 407 of the toy. Plush material retaining shoulder 402 is design to assist in retaining the plush material in the body 406 of plush toy 400. Skeleton 407 is comprised of legs 405, arms 403, and spine 404. Each part of skeleton 407 is made up of skeleton pieces 417 that, in this embodiment, are made of plastic with both female and male coupling ends. The male coupling end fits into the female coupling end of another skeleton piece 417 such that they become attached but can also move rotationally within the coupling end. This movement allows skeleton 407 to be moveable and poseable for the enjoyment of the user. The arms, legs and body can be moved into various positions and held in position by skeleton 407.

Body 406 is comprised of skeleton 407, stuffing 420 and plush cover 419. Stuffing 420 fits over and around skeleton 407 and provides the soft feeling desired in plush toys. As in the preferred embodiment, stuffing 420 is polyester fiber but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 419 forms the exterior of the plush toy and includes the preferred exterior design of the toy. Plush cover 419 can be manufactured using any of many methods well known in the art, but this embodiment as in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. Plush cover 419 also includes neck hole 418 where the neck connector 408 fits through plush cover 419.

In this embodiment, neck connector 408 is formed as part of plush material retaining shoulder 402. Plush material retaining shoulder 402 connects to skeleton 407 by skeleton connector 410. Plush material retaining shoulder 402 is also shaped to prevent stuffing 420 from exiting through neck hole 418. It achieves this by the shoulder portion of the plush material retaining shoulder 402 pushing stuffing 420 into the plush body and forming a barrier that prevents stuffing 420 from coming out of neck hole 318. Neck connector 408 and plush material retaining shoulder 402 are formed of plastic in this embodiment, but any suitable material known in the art could be utilized.

Neck connector 408 is designed to couple to head 401 through a variety of coupling types shown in this disclosure. In this embodiment, neck connector 408 is threaded screw type connector which attaches to complementary threads in the neck receptacle contained in head 401 In this embodiment, the head 401 rotates onto neck connector 408 with a screwing motion. As the complementary threads in neck connector 408 and neck receptacle travel along their path, head 401 attaches to body 406. In this configuration, the head 401 is able to rotate in a circular motion around its vertical axis. Further, the head is easily removed and replaced with another head for the enjoyment of its user. With plush material retaining shoulder 402 attached to skeleton connector 410, the body 406 may be filled with stuffing 420 that is retained by plush cover 419. Further, plush material retaining shoulder 402 prevents stuffing 420 from exiting through neck hole 418 in plush cover 419. The easy connection of head 401 to neck connector 408 allows the use of unique and different materials for head 401 including PVC and other plastics. When head 401 is fitted onto neck connector 408 the complete toy is formed, including the plush body 406 and PVC head 401. The head 401 is rotatable around its vertical axis and removable. The body is posable but also retains the desired characteristics of a plush body. The characteristics of this plush toy with PVC head are unique and provide playing enjoyment for the user.

Figure 11:
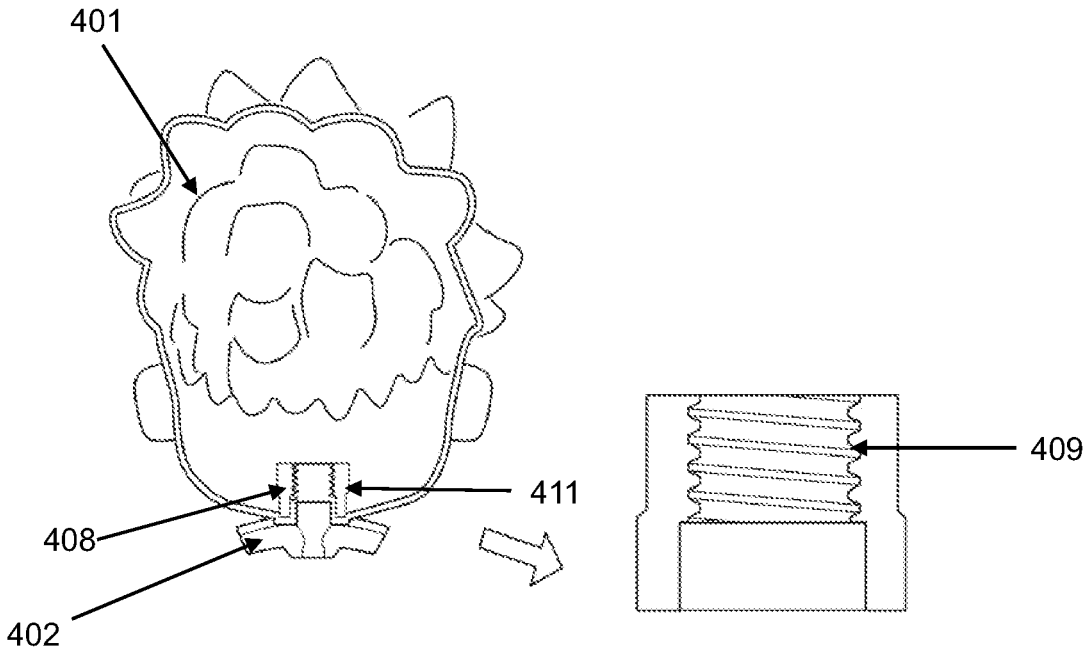
FIG. 11 is a view of the neck connector of the fourth embodiment of the plush toy with internal skeleton and PVC head.

FIG. 11 shows a view of head 401 with neck connector 308 inserted in neck receptacle 411. In this view, plush material retaining shoulder 402 is also shown connected to neck connector 408. In this embodiment, neck connector 408 has a generally round post shape with screw type threads around the exterior. Neck connector 408 has a base where it is attached to plush material retaining shoulder 402. The threaded post of neck connector 308 is designed to couple with complementary threads located in neck receptacle 411. Neck receptacle 411 fits in the base of head 401 and is the means to attach head 401 to body 406.

The interior of neck receptacle 411 is generally shaped as a cylindrical socket, with a size that is slightly greater than that of neck receptacle 411 and internal threads that couple with the external threads of neck connector 408. Once neck connector 408 is inserted in neck receptacle 411, neck connector 408 is rotated so that the external threads of neck connector 408 couple with the internal threads of neck receptacle 411. These coupled threads move along their path until neck connector 408 is firmly seated in neck receptacle 411.

Figure 12:
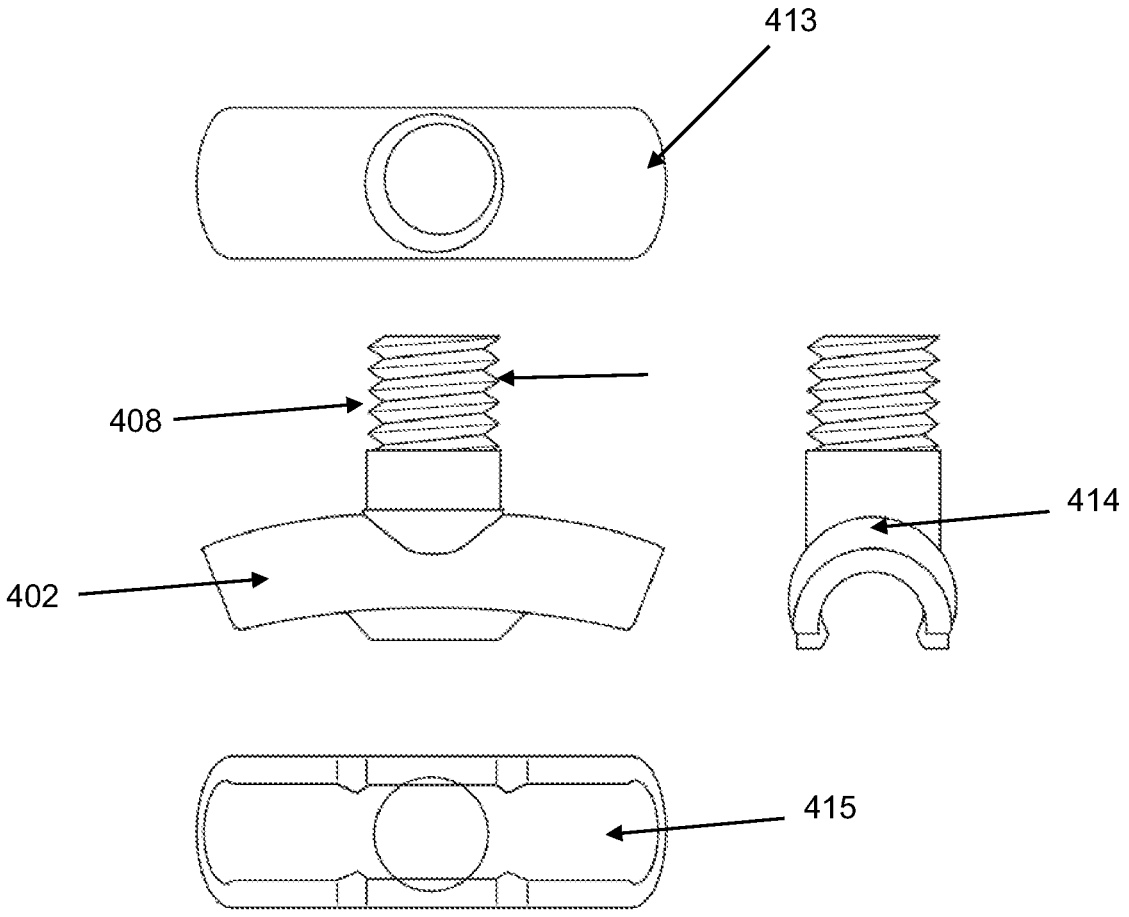
FIG. 12 is a view of the plush material retaining shoulder of the fourth embodiment of the plush toy with internal skeleton and PVC head.

FIG. 12 shows a detailed view of plush material retaining shoulder 402 and neck connector 408. In this view, threads 421 of neck connector 408 are clearly visible. Threads 421 are discussed in detail in relation to FIG. 11 above. Also in this view, shoulder top 413 shows the top portion of plush material retaining shoulder 402. Side shoulder 414 is the side view of plush material retaining shoulder 402. Lastly, bottom shoulder 415 is a bottom view of plush material retaining shoulder 402. In the preferred embodiment, neck connector 408 and plush material retaining shoulder 402 are made of molded plastic, but could be made of any other suitable material well known in the art.

Although the present invention has been described in relation to the above disclosed preferred embodiment, many modifications in design, implementation, systems and execution are possible while still maintaining the novel features and advantages of the invention. The preferred embodiment is not meant to limit the scope of the patent in any way, and it should be given the broadest possible interpretation consistent with the language of the disclosure on the whole.

The invention claimed is:

1. A plush toy with a head and a body comprising:

an internal skeleton, the skeleton being flexible and comprising one or more individual skeleton pieces each with a first end and a second end, where the first end of one skeleton piece connects to the second end of a second skeleton piece;

a plush body cover being formed of a first material, the plush body cover comprising the body of the plush toy and having at least one opening for attachment of a head for the toy, the plush cover further being configured to cover the skeleton and to retain a stuffing material for the plush toy;

a plush material retaining shoulder connected to the skeleton, the plush material retaining shoulder being configured to prevent the stuffing material from exiting the plush body cover through the opening for attachment of the head for the toy;

a neck connector attached to the skeleton, the neck connector being configured to couple and decouple with a neck receptacle, the neck receptacle being connected to the head of the toy and allowing attachment and detachment of the head from the body of the plush toy; and the head of the plush toy being formed of a second material.

2. The plush toy of claim 1 where the first material is selected from the group consisting of plush material, soft boa fabric, tricot fabric, pearl velvet cloth, wide wale soft boa, polar fleece, velboa, printed polyester, pile textiles, cotton, mohair, wool, worsted yarn, simulated fur, real fur, silk with a cotton backing, and terry cloth.

3. The plush toy of claim 1 where the second material is selected from the group consisting of PVC, plastic, rubber and metal.

4. The plush toy of claim 1 where the neck connector is a tabbed connector and the neck receptacle is a post with a lip.

5. The plush toy of claim 1 where the neck connector is a ball and the neck receptacle is a socket.

6. The plush toy of claim 1 where the neck connector is a round connector with at least one tab and the neck receptable is a round socket with at least one slot for coupling with the at least one tab of the neck connector.

7. The plush toy of claim 1 where the neck connector is a threaded post and the neck receptacle is a threaded socket.

8. The plush toy of claim 1 where the stuffing material is selected from the group comprising polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

* * * * *